US008858028B2

(12) United States Patent
Kim

(10) Patent No.: US 8,858,028 B2
(45) Date of Patent: Oct. 14, 2014

(54) LED LIGHTING APPARATUS

(75) Inventor: Kyung Hwan Kim, Chungcheongnam-do (KR)

(73) Assignees: New Technology Bank Co., Ltd., Daejeon (KR); Kyung Kwan Kim, Chungcheongnam-do (KR)

( * ) Notice: Subject to any disclaimer, the term of this patent is extended or adjusted under 35 U.S.C. 154(b) by 19 days.

(21) Appl. No.: 13/883,403

(22) PCT Filed: Aug. 31, 2012

(86) PCT No.: PCT/KR2012/007017

§ 371 (c)(1), (2), (4) Date: May 3, 2013

(87) PCT Pub. No.: WO2013/032293

PCT Pub. Date: Mar. 7, 2013

(65) Prior Publication Data

US 2013/0223069 A1 Aug. 29, 2013

(30) Foreign Application Priority Data

Sep. 3, 2011 (KR) ..... 10-2011-0089307
Nov. 9, 2011 (KR) ..... 10-2011-0116222

(51) Int. Cl.
*F21V 13/04* (2006.01)
*F21V 7/04* (2006.01)

(Continued)

(52) U.S. Cl.
CPC ..... *F21V 13/04* (2013.01); *F21V 7/048* (2013.01); *F21V 21/30* (2013.01); *F21Y 2101/02* (2013.01); *F21S 2/005* (2013.01);

(Continued)

(58) Field of Classification Search
USPC ..... 362/249.02, 372, 371
See application file for complete search history.

(56) References Cited

U.S. PATENT DOCUMENTS

2005/0068781 A1* 3/2005 Nakayama et al. ..... 362/473
2009/0109670 A1* 4/2009 Boyer ..... 362/234

(Continued)

FOREIGN PATENT DOCUMENTS

KR 10-2010-0045341 A 5/2003
KR 10-2010-0057340 A 5/2010

(Continued)

*Primary Examiner* — Laura Tso
(74) *Attorney, Agent, or Firm* — Rabin & Berdo, P.C.

(57) ABSTRACT

The present invention relates to a LED lighting apparatus, comprising a quadrilateral-shaped casing with side walls inclined; a LED lighting module array disposed inside the casing and composed of a plurality of LED lighting modules lined up to emit light; a converter formed on a portion of the outside of the casing supplying power to the LED lighting modules; and a multi-bending reflection minor reflecting light emitted from the LED lighting modules, wherein the LED lighting module array comprises a LED module base combined with a portion of the upper inside surface of the casing; a plurality of LED module brackets connected to a lower portion of the LED module base; a plurality of metal PCB boards combined with a lower portion of each LED module bracket; a plurality of LED chips mounted on the metal PCB boards; and a plurality of lenses concentrating rays of light emitting from the LED chips into focus. Further, the lenses of the LED lighting apparatus according to the present invention have either a plurality of curved surfaces or various curvatures.

19 Claims, 11 Drawing Sheets

(51) Int. Cl.

| | |
|---|---|
| ***F21V 21/30*** | (2006.01) |
| ***F21S 2/00*** | (2006.01) |
| ***F21V 29/00*** | (2006.01) |
| ***F21V 29/02*** | (2006.01) |
| ***F21V 23/00*** | (2006.01) |
| ***F21V 5/04*** | (2006.01) |
| *F21Y 101/02* | (2006.01) |
| *F21V 19/02* | (2006.01) |

(52) U.S. Cl.

CPC ..... *F21V 29/2243* (2013.01); *F21V 19/02* (2013.01); *F21V 29/004* (2013.01); *F21V 29/02* (2013.01); *F21V 23/008* (2013.01); *F21V 29/027* (2013.01); *F21V 5/04* (2013.01)

USPC ..... 362/249.02; 362/372; 362/371

(56) References Cited

U.S. PATENT DOCUMENTS

| | | | | |
|---|---|---|---|---|
| 2009/0323343 | A1* | 12/2009 | Wang | 362/249.11 |
| 2011/0006688 | A1 | 1/2011 | Shim | |
| 2013/0051059 | A1* | 2/2013 | Abai et al. | 362/523 |
| 2013/0058076 | A1* | 3/2013 | Ni | 362/184 |
| 2013/0094211 | A1* | 4/2013 | Drake et al. | 362/247 |
| 2013/0100689 | A1* | 4/2013 | Ohashi et al. | 362/476 |

FOREIGN PATENT DOCUMENTS

| | | | |
|---|---|---|---|
| KR | 10-2011-0078319 | A | 7/2011 |
| KR | 10-2011-0080210 | A | 7/2011 |

* cited by examiner

LED LIGHTING APPARATUS

TECHNICAL FIELD

The present invention relates to a LED lighting apparatus, more specifically, relates to a LED lighting apparatus which maximizes the radiation of heat from the LED chips and freely adjusts the angle of its LED lighting module, wherein the LED lighting apparatus adopts lenses with various shapes.

BACKGROUND ART

Generally, a LED lighting device is characterized as an electronic device converting electric energy into light energy using LED chips installed on a printed circuit board; therefore, in case a high-powered LED lighting device is needed, there is a problem that inevitable heat from the LED chips should be effectively released.

Accordingly, the temperature of the LED lighting device should be controlled at a suitable level, and if it is not guaranteed, there might be difficulties in efficiency and durability of the LED lighting device.

Moreover, the light emitted from a LED lamp would not be beamed down to a long distance because the unit capacity of the LEDs, which is installed in the lamp, is relatively small and the LEDs emit light only through their surfaces. Especially, a LED lighting device cannot be applied to sports facilities indoor or outdoor, which are known to need large amount of light at a time, due to severe glairiness of LEDs compared to the light source of a general lighting device. In addition, a LED lighting device is well known to have a problem that it cannot provide uniform ratio of illuminance.

DISCLOSURE OF INVENTION

Problems to be Solved

Therefore, the present invention has been made in view of the above problems, and it is an object of the present invention to provide a LED lighting apparatus radiating heat with a heat radiation plate mounted on the upper portion of the casing, the heat conducted through a LED module base and a LED module bracket.

The second object of the present invention is to provide a LED lighting apparatus which concentrates rays of light emitted from LED chips into focus and beams it down to a long distance.

The third object of the present invention is to provide a LED lighting apparatus whose lighting angle is freely adjusted and a LED lighting apparatus having a plurality of lenses whose lighting angles can be independently adjusted.

The fourth object of the present invention is to provide a LED lighting apparatus having a cooling fan releasing heat in a convective manner.

The fifth object of the present invention is to provide a LED lighting apparatus comprising a plurality of lenses having a curved surface, the lenses arranged in a composite manner, so as to be appropriate to the facilities where the LED lighting apparatus is installed.

Solutions for Problems

To overcome the above discussed problems, the present invention, as the first embodiment, provides an asymmetric LED lighting apparatus, comprising a quadrilateral-shaped asymmetric casing with a side wall inclined; a LED lighting module array disposed inside the casing and composed of a plurality of LED lighting modules lined up to emit light; a converter formed on a portion of the outside of the casing and a power supply for the LED lighting modules; and a multi-bending reflection mirror reflecting light emitted from the LED lighting modules, wherein the LED lighting module array comprises a LED module base combined with a portion of the upper inside surface of the casing; a plurality of LED module brackets connected to a lower portion of the LED module base; a plurality of metal PCB boards combined with a lower portion of each LED module bracket; a plurality of LED chips mounted on the metal PCB boards; and a plurality of lenses concentrating rays of light emitting from the LED chips into focus.

The second embodiment of the present invention is directed to providing a symmetric LED lighting apparatus, comprising a quadrilateral-shaped symmetric casing with both side walls inclined; a LED lighting module array disposed inside the casing and composed of a plurality of LED lighting modules lined up to emit light; a converter separately formed from the casing and a power supply for the LED lighting modules; and a multi-bending reflection mirror reflecting light emitted from the LED lighting modules, wherein the LED lighting module array comprises a LED module base combined with a portion of the upper inside surface of the casing; a plurality of LED module brackets connected to a lower portion of the LED module base; a plurality of metal PCB boards combined with a lower portion of each LED module bracket; a plurality of LED chips mounted on the metal PCB boards; and a plurality of lenses concentrating rays of light emitting from the LED chips into focus.

Each lens is combined with a lens base, and the lens and the lens base are combined with a lens base cover.

The casing comprises a heat radiation plate to release heat.

The casing further comprises a cover allowing light to transmit in the lower surface.

Further, the LED module brackets comprise an arch-shaped concave upper portion and a quadrilateral-shaped flat lower portion, wherein the upper portion and the lower portion are connected with each other using a plurality of supporting rods.

The LED module bracket and the LED module base are joined together using LED module clamps. In this case, the angle of the LED lighting module is adjusted by changing the configuration of the LED module bracket using the bolts of the LED module clamp.

Further, the angle of the LED lighting module is in the range of 0~45°.

To achieve the object of the present invention, the lens is in the shape of convex.

The LED lighting modules are disposed independently or in groups to form the LED lighting module array, and wherein the angles of the LED lighting modules are independently adjusted to either the same or different angle.

The LED lighting module array comprises a cooling fan attached to a side portion of the LED module base.

The third embodiment of the present invention is directed to providing a LED lighting apparatus with a composite lens, comprising a quadrilateral-shaped casing serving as housing and having a lower portion open; a LED lighting module array disposed inside the casing and composed of a plurality of LED lighting modules lined up to emit light; a converter formed on a portion of the outside of the casing and a power supply for the LED lighting modules; and a multi-bending reflection minor reflecting light emitted from the LED lighting modules, wherein the LED lighting module array comprises a LED module base combined with a portion of the upper inside surface of the casing; a plurality of LED module brackets connected to a lower portion of the LED module base; a plurality of metal PCB boards combined with a lower portion of each LED module bracket; a plurality of LED chips mounted on the metal PCB boards; and a plurality of lenses concentrating rays of light emitting from the LED chips into focus, the lenses having a plurality of curved surfaces or various curvatures.

The casing is either asymmetric with a side wall inclined or symmetric with both side walls inclined.

Moreover, the LED lighting modules are disposed independently or in groups to form the LED lighting module array, and wherein the angles of the LED lighting modules are independently adjusted to either the same or different angle.

Further, the lower portion of the lens is formed in one of the shapes of a circle, a quadrilateral or a polygon, wherein the curved surface of the lens is formed in the shape of semi-spherical convex lens or oval convex lens.

The lens of the present invention might be long and bar-shaped.

To achieve the object of the present invention, an O-ring is inserted between the lens and the lens base cover.

The LED lighting module array comprises a cooling fan attached to a side portion of the LED module base.

Effects of Invention

The present invention is advantageous in that it provides a LED lighting apparatus radiating heat with a heat radiation plate mounted on the upper portion of a casing, the heat from LED chips conducted through a LED module base and a LED module bracket, thereby increasing efficiency and durability of the LED lighting apparatus.

In addition, the present invention is advantageous in increasing efficiency and durability of the LED lighting apparatus in that the present invention releases heat from LED chips in a convective manner using a cooling fan installed in the LED module base.

Moreover, the present invention allows those concerned to concentrate rays of light into focus using lens to carry it at a long distance, and further allows them to freely adjust the angle of the LED lighting module to whatever they want.

The present invention, besides, has superiority in concentrating rays of light into focus in accordance with the facilities where the invention is installed and its purpose using a lens with a plurality of curved surfaces or various curvatures.

DETAILED DESCRIPTION OF THE PREFERRED EMBODIMENTS

Hereinafter, a LED lighting apparatus in accordance with a preferred embodiment of the present invention will be described in detail with reference to the annexed drawings.

First Embodiment

Figure 1:
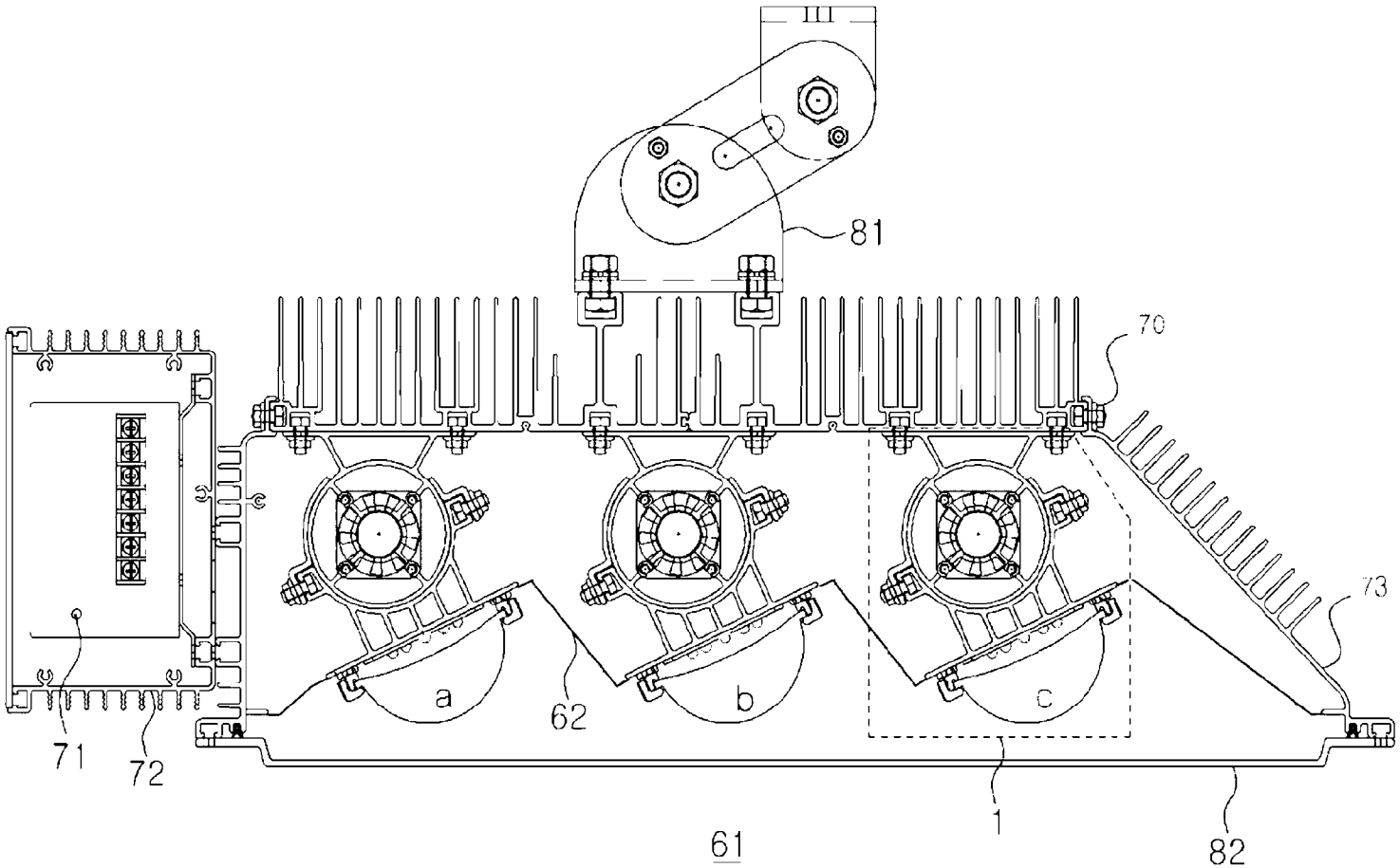
FIG. 1 is a cross-sectional view of an asymmetric LED lighting apparatus with asymmetric side walls according to the first preferred embodiment of the present invention.
Figure 2:
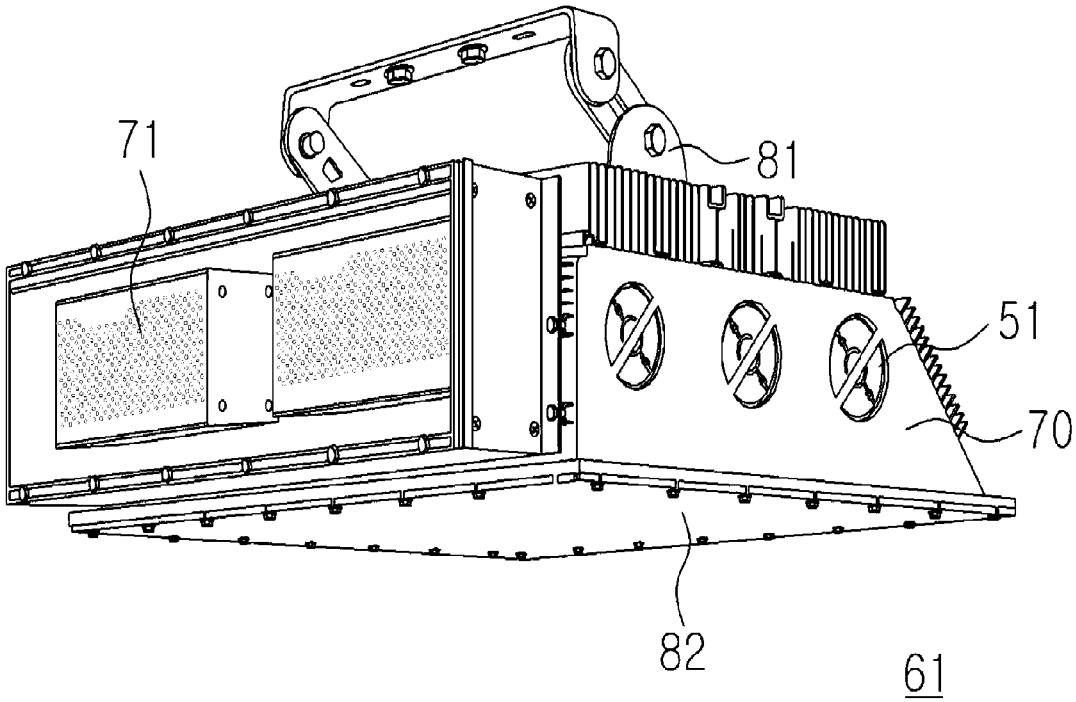
FIG. 2 is a perspective view of an asymmetric LED lighting apparatus according to the first preferred embodiment of the present invention, showing the bottom right side of the present invention.
Figure 3:
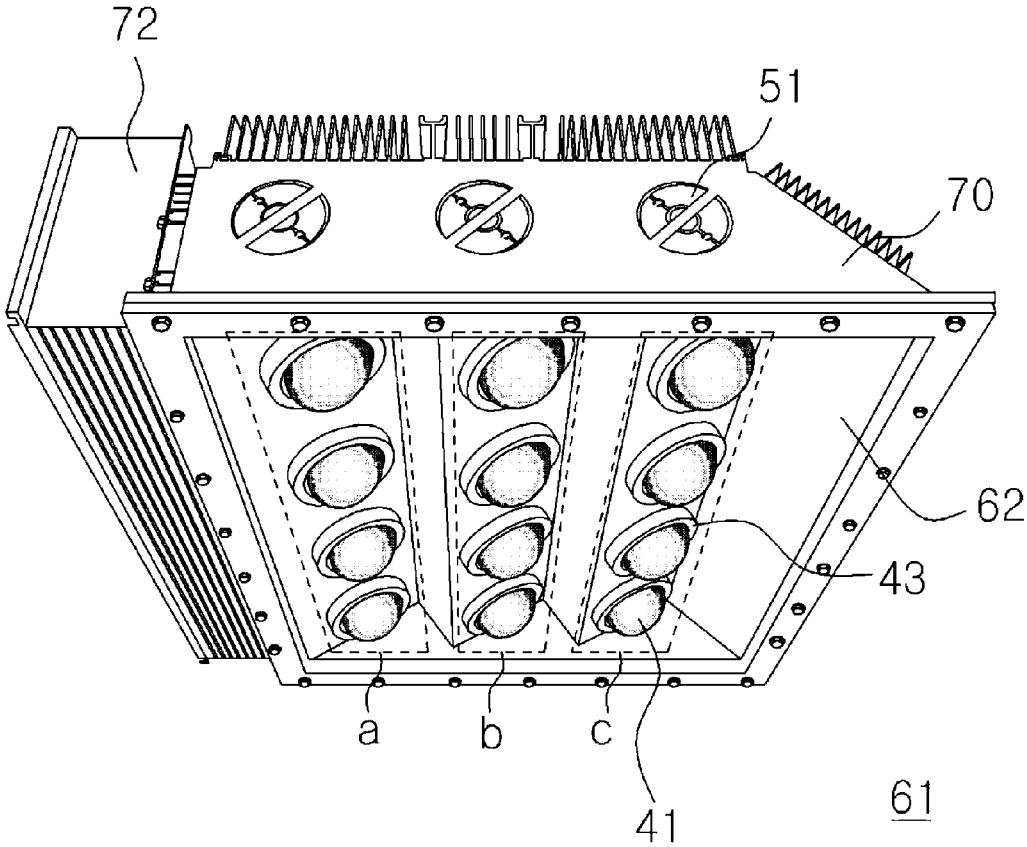
FIG. 3 is a perspective view of an asymmetric LED lighting apparatus according to the first preferred embodiment of the present invention, showing the right side of the present invention.

FIG. 1 is a cross-sectional view of an asymmetric LED lighting apparatus according to the first preferred embodiment of the present invention, FIG. 2 is a perspective view of the asymmetric LED lighting apparatus, showing the bottom right side of the present invention, and FIG. 3 is a perspective view of the right side of the asymmetric LED lighting apparatus.

As shown in FIG. 1-3, an asymmetric LED lighting apparatus 61 according to the first preferred embodiment of the present invention comprises a casing 70; a converter 71; LED lighting module arrays a, b, c composed of a plurality of LED lighting modules 1 lined up; and a multi-bending reflection minor 62.

The casing 70 is a quadrilateral-shaped housing and comprises a bottom portion open and a side wall 73 aslope.

A heat radiation plate with radiation fins is disposed on the upper portion of the casing 70 for releasing heat, the radiation fins perpendicular to the surface of the casing 70.

The casing 70 is connected to a lighting direction adjuster 81 and installed to either the ceiling or rails using hinges thereafter.

A plurality of LED lighting module arrays a, b, c emitting light are disposed inside the casing 70.

Said LED lighting module arrays a, b, c comprise a plurality of LED lighting modules 1 lined up either in column or in line. As lined up, the number of said LED lighting modules 1 is determined according to the capacity of the LED lighting apparatus or its uses.

In addition, the LED lighting modules 1 are arranged independently inside the LED lighting module arrays a, b, c, or said LED lighting modules 1 are disposed in groups inside the LED lighting module arrays a, b, c, the groups are composed of either the same kind of modules or different kind of modules. Further, the angles of said LED lighting modules 1 are independently adjusted, if necessary.

The multi-bending reflection minor 62, which is combined with the LED lighting modules 1, reflects light emitted so as to increase the reflection efficiency.

A cover 82 is attached to the bottom surface of the casing 70 using bolts or clips.

It is preferable that the cover 82 is transparent or semitransparent so as to allow light to transmit, and that said cover 82 is made up of plastic, tempered glass, and so forth.

The converter 71 is formed on a portion of the outside of the casing 70, supplying dc power to the LED lighting modules 1. In this case, the converter 71 is protected by a converter external case 72 which is quadrilateral-shaped with one of its portions open.

A converter external case 72 is composed of a heat radiation plate with patterns perpendicular to the surface of the case for releasing heat.

Figure 4:
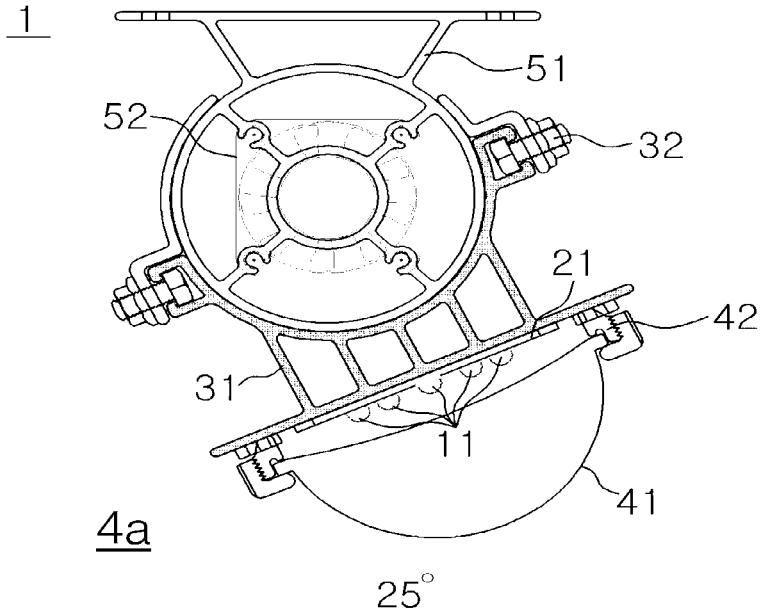
FIGS. 4*a* and 4*b* are cross-sectional views of a LED lighting module according to the first preferred embodiment of the present invention.
Figure 4:
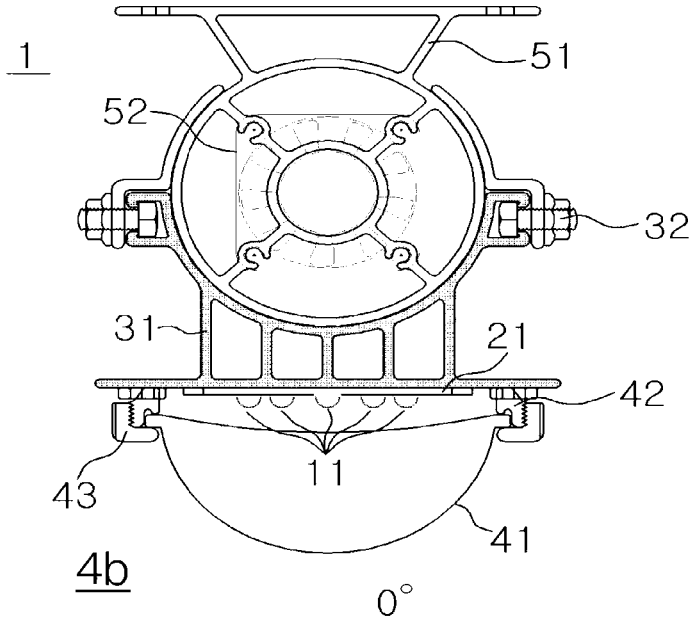

FIGS. 4*a* and 4*b* are cross-sectional views of a LED lighting module 1 according to the present invention.

A plurality of the LED lighting modules 1 of the present invention is lined up to form a LED lighting module array. As shown in FIGS. 4*a* and 4*b*, said LED lighting module 1 comprises a portion of a LED module base 51 combined with a portion of the upper inside surface of the casing; a LED module bracket 31 connected to said LED module base 51; a metal PCB board 21 combined with the LED module bracket 31; a plurality of LED chips 11 mounted on said metal PCB board 21; and a lens 41 concentrating rays of light emitting from the LED chips 11 into focus and irradiating it to the surroundings, and further comprises a lens base 42 to combine the lens 41 and a lens base cover 43 holding the lens 41 and the lens base 42 together.

Therefore, the LED lighting module array comprises the LED module base 51 combined with a portion of the upper inside surface of the casing; a plurality of LED module brackets 31 connected to a lower portion of said LED module base 51; a plurality of metal PCB boards 21 combined with a lower portion of each LED module bracket; a plurality of LED chips 11 combined with said metal PCB board; and a plurality of lenses 41 concentrating rays of light emitting from said LED chips 11 into focus.

In this case, said LED module base 51 might comprise a cooling fan 52 at a portion of its side in accordance with either the air temperature of the surroundings or the heat generation conditions.

In this case, the LED module base 51 is combined with a portion of the upper inside surface of the casing 70. The LED module base 51 is in the shape of a circle, a quadrilateral or a polygon and comprises supporting rods.

The upper combining portion of the LED module base 51 is attached to the casing 70 using bolts or snap fits.

In addition, the LED module base 51 has a coupling portion formed by molding so as to be assembled and attached to the LED module bracket 31.

In case the cooling fan 52 is included in the embodiment, said cooling fan 52 is attached to a side portion of the LED module base 51 and it operates according to the control signal of the converter 71. The capacity of the cooling fan 52 varies according to the number of the LED lighting modules 1 included in the LED lighting module arrays a, b, c. The capacity of the cooling fan varies according to the capacity of the LED lighting apparatus, and it might be omitted when the heat generated from the LED lighting module 1 is not critical.

The LED module bracket 31, which is mounted to a lower portion of the LED module base 51, has an arch-shaped concave upper portion serving as a connecting part and a quadrilateral-shaped flat lower portion, wherein a plurality of supporting rods are included between the upper portion of the LED module bracket 31 and the lower portion of the LED module base 51.

Moreover, a plurality of molded bolt holes are formed on a portion of the LED module base 51 so that the cooling fan 52 can be assembled without any additional processing, the cooling fan 52 determined to be attached according to the capacity of the LED lighting apparatus.

The LED module base 51 and the LED module bracket 31 are in the pipe structure so as to maximize the convection of the air induced by the cooling fan 52.

The LED module bracket 31 and the LED module base 51 are joined using LED module clamps 32.

The LED module bracket 31 further comprises a metal PCB board 21, a lens base 42 for installing the lens 41, and a lens base cover 43 on its lower portion, wherein a control circuit which makes the LED chips 11 work is printed on the upper surface of said metal PCB board 21 and the LED chips 11 are mounted on the lower surface of the metal PCB board 21.

The LED chips 11 emit light in accordance with the control signal from the converter 71, wherein the light would be any color including red, green, blue and white. It is more preferable that a plurality of the LED chips 11 would be included together to emit light.

The lens 41, which is disposed on the lower portion of the LED chips 11, is attached to the lens base 42 installed at each end of the lower portion of the LED module bracket 31 and the lens base cover 43.

The lens 41 is in the shape of convex so as to concentrate rays of light from the LED chips 11 into focus and send them to a long distance.

The lens base 42 and the lens base cover 43 are disposed and installed at each end of the lower portion of the LED module bracket 31.

The lens base 42 is a molded part in order to install the lens 41, the lens base 42 manufactured by a bending process into the shape of "⌈ " or "⌋ ".

The lens base cover 43 is a fixing part combining the lens 41 with the lens base 42, wherein the lens base cover 43 is disposed at the outside of the lens base 42 and wraps the lens base 42 for fixing.

The lens base cover 43 is manufactured by a bending process into the shape of either "⌈ " and "⌋ " or "[" and "]".

FIG. 4*a* shows the LED lighting module installed at an angle of 25° and FIG. 4*b* shows the same kind of module installed at an angle of 0°.

Figure 5:
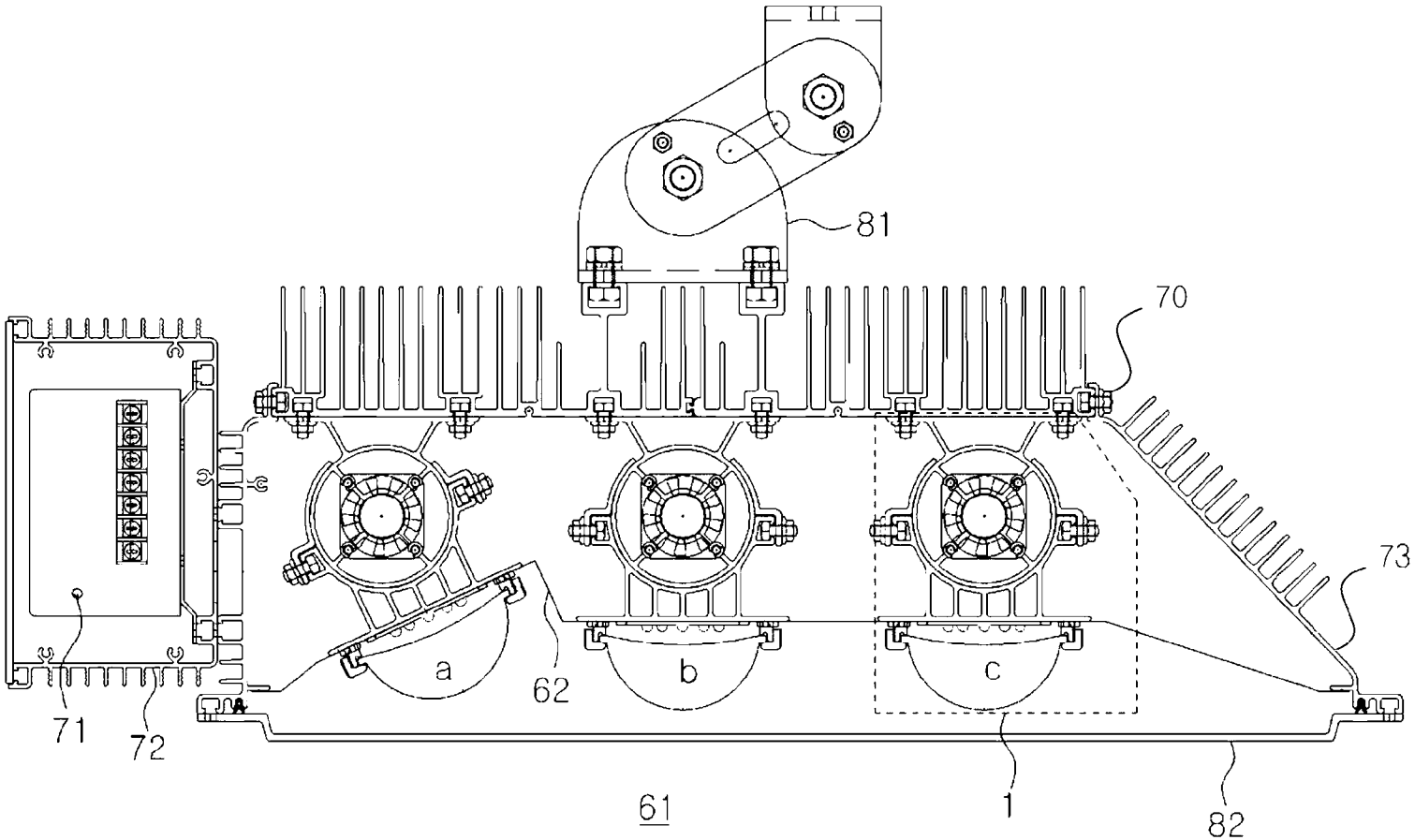
FIG. 5 is a cross-sectional view of an asymmetric LED lighting apparatus according to the first preferred embodiment of the present invention, showing various installation angles of its LED lighting modules.

FIG. 5 is a cross-sectional view of an asymmetric LED lighting apparatus according to the first preferred embodiment of the present invention, showing various installation angles of its LED lighting module arrays.

As shown in FIG. 5, the LED lighting module 1 and the LED lighting module arrays a, b, c can be installed at a different installation angle from each other in accordance with the capacity of the lighting apparatus, installation conditions, and so on. Furthermore, the installation angle of the multi-bending reflection mirror 62 combined to the LED lighting module arrays a, b, c, can be adjusted at the range of 0~45°, which is thought to be preferable.

The installation angle of the LED lighting module arrays a, b, c and the multi-bending reflection minor 62 is adjusted by changing the configuration between the LED module base 51 and the LED module bracket 31 using the bolts of the LED module clamp 32.

Second Embodiment

Figure 6:
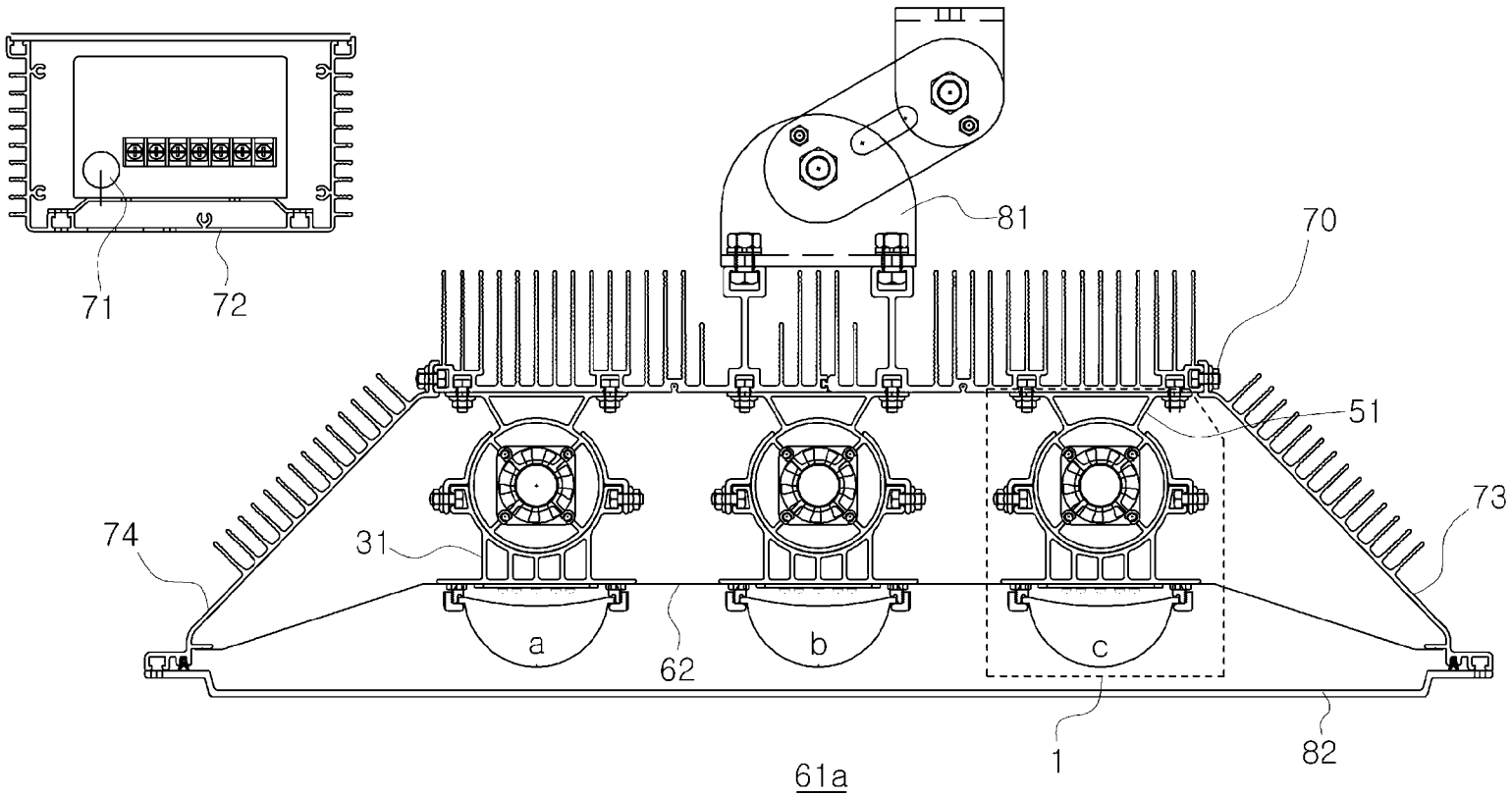
FIG. 6 is a cross-sectional view of a symmetric LED lighting apparatus according to the second preferred embodiment of the present invention, whose sides are symmetrically formed.
Figure 7:
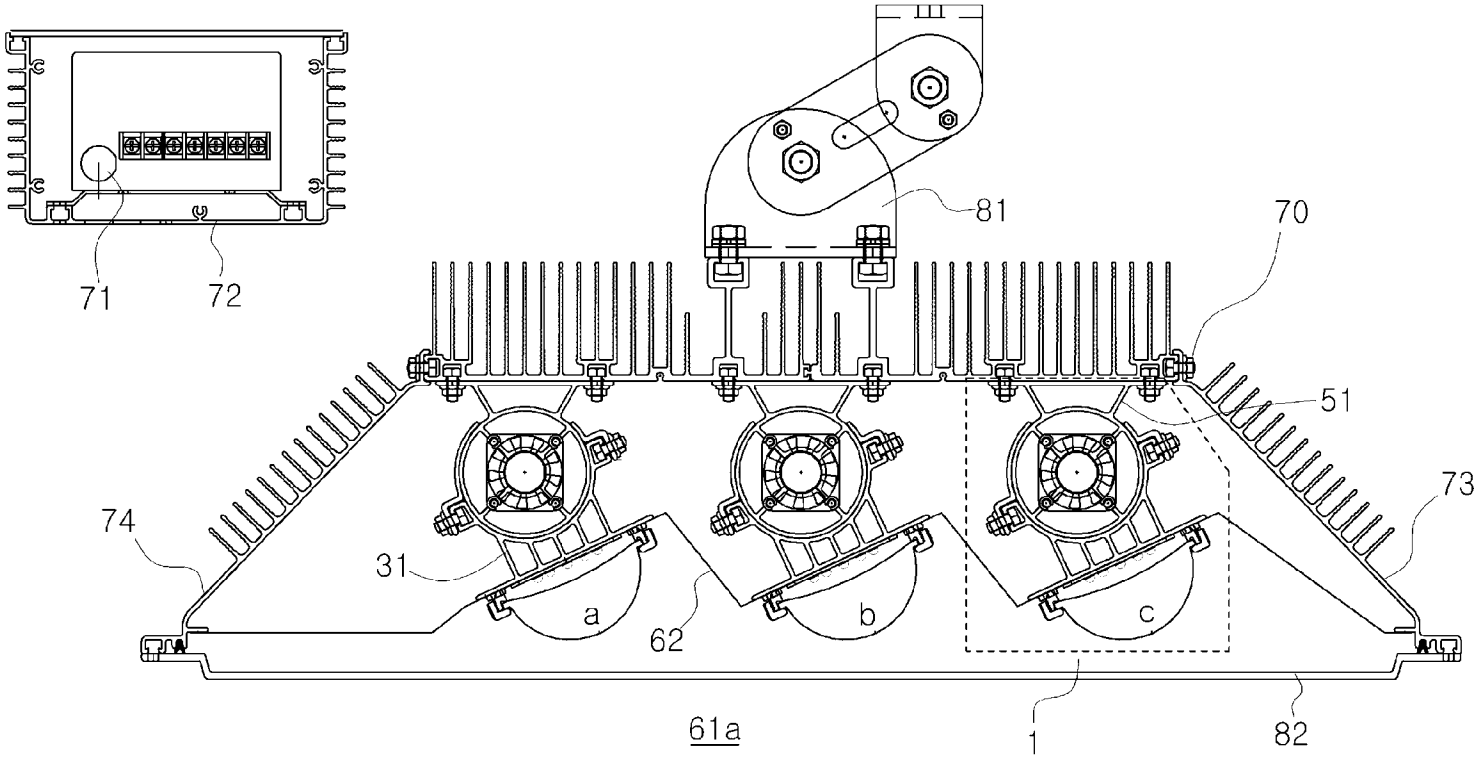
FIG. 7 is a cross-sectional view of a symmetric LED lighting apparatus according to the second preferred embodiment of the present invention, showing various installation angles of its LED lighting modules.

FIG. 6 shows a symmetric LED lighting apparatus according to the second preferred embodiment of the present invention and FIG. 7 shows various installation angles of LED lighting module arrays of a symmetric LED lighting apparatus.

As shown in FIGS. 6 and 7, a symmetric LED lighting apparatus 61*a* according to the second embodiment of the present invention is the same as the first embodiment except that the casing 70 further comprises a symmetric side wall 74 aslope and the converter 71 is separated from the casing 70.

The present invention maximizes the efficiency of heat radiation by conducting the heat from LED chips through the LED module clamp 32, which combines the LED module base 51 and the LED module bracket 31, and by conducting the heat to the heat radiation plate mounted on the surface of the casing 70 of the asymmetric or symmetric LED lighting apparatuses 61, 61*a*.

The LED module base 51 of the present invention is pipe-shaped; therefore, it can maximize the efficiency of heat radiation using the cooling fan 52 guiding cold air from the surroundings into the inside of the casing 70 and discharging hot air into the outside of the casing 70, the cooling fan 52 guiding the cold air through a hole formed at a side wall of the casing 70. Selectively, if necessary, the LED lighting module is determined not to have any cooling fan, which depends on the condition of the facilities where the LED lighting apparatus is installed.

The present invention is advantageous in that it can concentrate rays of light from the LED chips 11 into focus and send it to a long distance using a convex-shaped lens 41.

Moreover, the present invention is advantageous in that it can easily adjust the angle of the light in accordance with the facilities and its use by independently changing the configuration of the LED lighting modules and the LED lighting module arrays.

Third Embodiment

According to the third embodiment of the present invention, the LED lighting apparatus can concentrate rays of light into focus in accordance with the facilities and its use either with adopting a plurality of curved surfaces to the lens disposed inside the LED lighting apparatus or with changing the curvature of the lens.

Hereinafter, a LED lighting apparatus according to the third embodiment of the present invention will be described in detail.

Figure 8:
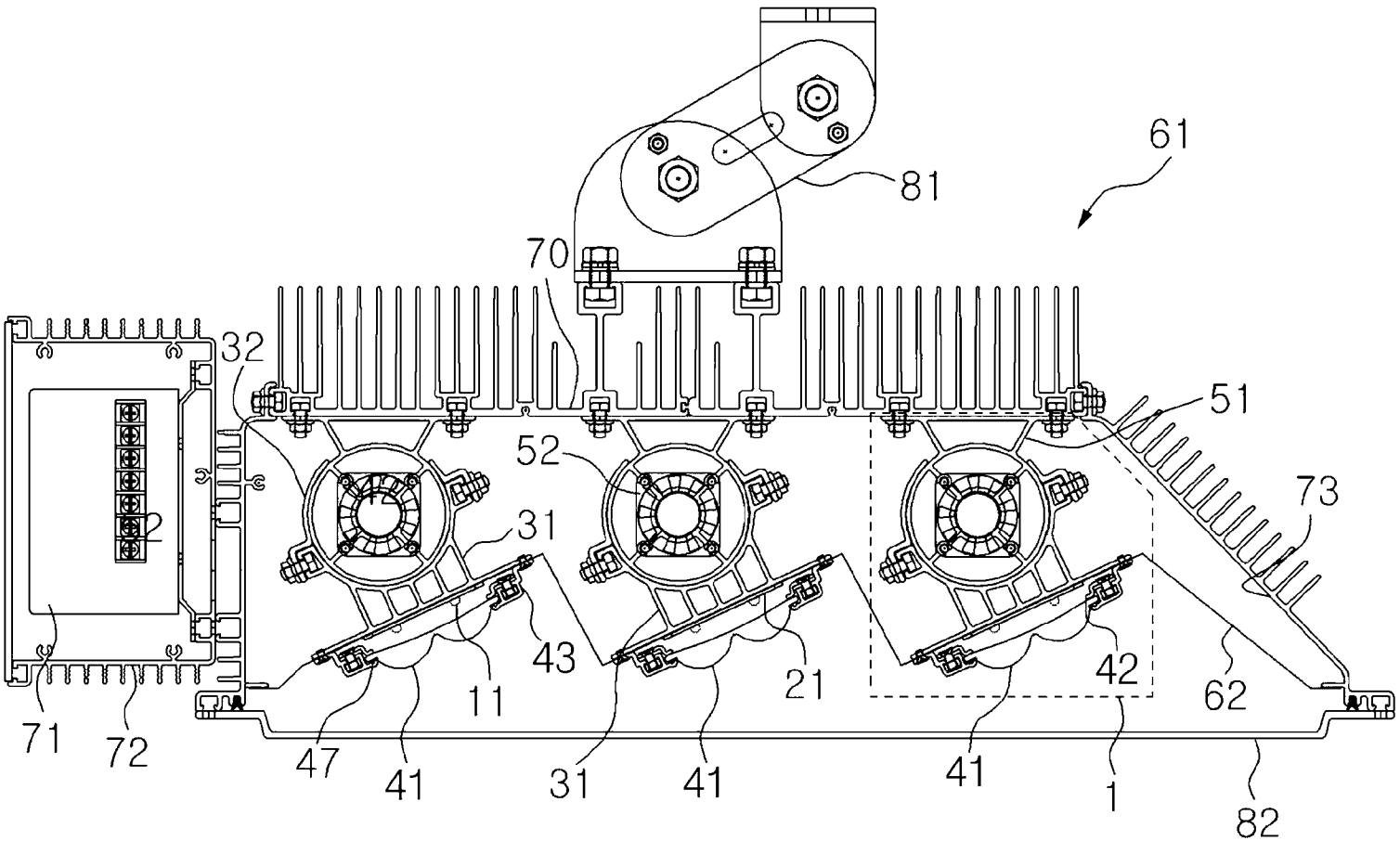
FIG. 8 is a cross-sectional view of an asymmetric LED lighting apparatus according to the third preferred embodiment of the present invention, whose sides are asymmetrically formed.
Figure 9:
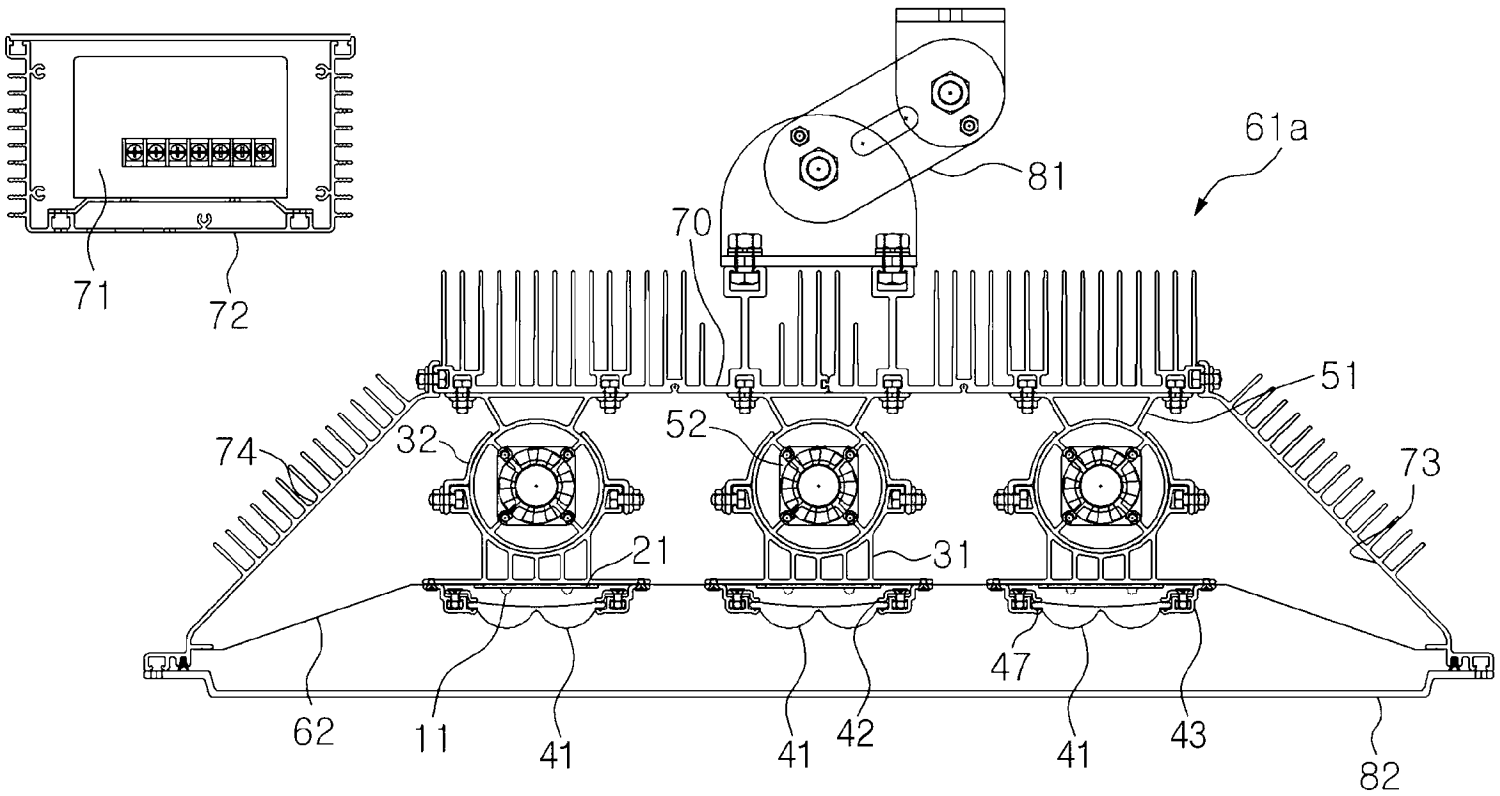
FIG. 9 is a cross-sectional view of a symmetric LED lighting apparatus according to the third preferred embodiment of the present invention, whose sides are symmetrically formed.

FIG. 8 is a cross-sectional view of an asymmetric LED lighting apparatus according to the third preferred embodiment of the present invention, whose sides are asymmetrically formed and FIG. 9 is a cross-sectional view of a symmetric LED lighting apparatus whose sides are symmetrically formed.

As shown in FIGS. 8 and 9, a LED lighting apparatus 61 with a composite lens according to the present invention comprises a casing 70; a LED lighting module array composed of a plurality of LED lighting modules lined up; a converter 71; and a multi-bending reflection minor 62.

In this case, the casing 70 is a quadrilateral-shaped housing with a lower portion open. The casing 70 might be asymmetric with only one side wall aslope, or, selectively, the casing 70 might be formed to be symmetric with both side walls aslope.

A heat radiation plate with radiation fins is disposed on the upper portion of the casing 70 for releasing heat, the radiation fins perpendicular to the surface of the casing 70.

The casing 70 is connected to a lighting direction adjuster 81 and installed to the ceiling or rails using hinges thereafter.

A plurality of LED lighting modules 1 emitting light are disposed inside the casing 70.

A plurality of LED lighting modules 1 lined up in column is inserted to the LED lighting module arrays a, b, c. The number of said LED lighting modules 1 and the number of the LED lighting module arrays a, b, c are determined in accordance with the capacity of the lighting apparatus and its use necessary.

In addition, the LED lighting modules 1 are arranged independently inside the LED lighting module arrays a, b, c, or said LED lighting modules 1 are disposed in groups inside the LED lighting module arrays a, b, c, the groups composed of either the same kind of modules or different kind of modules. Further, the angles of said LED lighting modules 1 are independently adjusted, if necessary.

A plurality of the LED lighting modules 1 is lined up to form the LED lighting module array. In this case, said LED lighting module array comprises a LED module base 51 combined with a portion of the upper inside surface of the casing; a plurality of LED module brackets 31 connected to said LED module base 51; a plurality of metal PCB boards 21 combined with the LED module brackets 31; a plurality of LED chips 11 mounted on said metal PCB boards 21; and a plurality of lenses 41 concentrating rays of light emitting from the LED chips 11 into focus and irradiating it to the surroundings, and further comprises a lens base 42 to combine the lens 41 and a lens base cover 43 holding the lens 41 and the lens base 42 together.

In this case, as described before, the LED module base 51 is combined with a portion of the upper inside surface of the casing 70. The LED module base 51 is in the shape of a circle, a quadrilateral or a polygon, and comprises supporting rods.

The upper combining portion of the LED module base 51 is attached to the casing 70 using bolts or snap fits.

In addition, the LED module base 51 has a coupling portion formed by molding so as to be assembled and attached to the LED module bracket 31.

In case the cooling fan 52 is included in the embodiment, said cooling fan 52 is attached to a side portion of the LED module base 51 and it operates according to the control signal of the converter 71. The capacity of the cooling fan 52 varies according to the capacity of the LED lighting apparatuses 61, 61*a*, and it might be omitted when the heat generated from the LED lighting source is not critical.

The LED module bracket 31, which is mounted to a lower portion of the LED module base 51, has an arch-shaped concave upper portion serving as a connecting part and a quadrilateral-shaped flat lower portion, wherein a plurality of supporting rods are included between the upper portion of the LED module bracket 31 and the lower portion of the LED module base 51.

Moreover, a plurality of molded bolt holes are formed on a portion of the LED module base 51 so that the cooling fan 52 can be assembled without any additional processing, the cooling fan 52 determined to be attached according to the capacity of the LED lighting apparatus.

The LED module base 51 and the LED module bracket 31 are in the pipe structure so as to maximize the convection of the air induced by the cooling fan 52.

The LED module bracket 31 and the LED module base 51 are joined together using LED module clamps 32.

The LED module bracket 31 further comprises a metal PCB board 21, a lens base 42 for installing the lens 41, and a lens base cover 43, wherein a control circuit which makes LED chips work is printed on the upper surface of said metal PCB board 21 and the LED chips 11 are mounted on the lower surface of the metal PCB board 21.

The LED chips 11 emit light in accordance with the control signal from the converter 71, wherein the light would be any color including red, green, blue and white. It is more preferable that a plurality of the LED chips 11 would be joined together to emit light.

The lens 41 is long and bar-shaped, comprising a lower portion and a curved surface formed on said lower portion.

The lower portion of the lens 41 is formed in one of the shapes of a circle, a quadrilateral or a polygon.

And, the curved surface formed on said lower portion of the lens 41 is formed in the shape of semi-spherical convex lens or oval convex lens. Again, the lens 41 is formed long and bar-shaped.

The lens 41, which is disposed on the lower portion of the LED chips 11, is attached to the lens base 42 installed at each end of the lower portion of the LED module bracket 31 and the lens base cover 43.

The lens 41 is in the shape of convex so as to concentrate rays of light from the LED chips 11 into focus and transmit them to a long distance.

The lens base 42 and the lens base cover 43 are disposed and installed at each end of the lower portion of the LED module bracket 31.

The lens base 42 is a molded part in order to install the lens 41, the lens base 42 manufactured by a bending process into the shape of "⌈" or "⌋".

The lens base cover 43 is a fixing part included in order to combine the lens 41 and the lens base 42, wherein the lens base cover 43 is disposed at the outside of the lens base 42 and wraps the lens base 42 for fixing.

The lens base cover 43 is manufactured by a bending process into the shape of either "⌈" and "⌋" or "[" and "]".

An O-ring 47 is disposed between the lens 41 and the lens base cover 43.

The O-ring 47 is in the shape of ring with semi-spherical cross-section, which is made of synthetic rubber, synthetic resins and so on.

The O-ring 47 is to seal up the gap between the lens 41 and the lens base cover 43.

Finally, the LED lighting module 1 can be installed at a different installation angle from each other in accordance with the capacity of the lighting apparatus, installation conditions, and so on. Furthermore, the installation angle of the multi-bending reflection mirror 62 combined to the LED lighting modules 1 can be adjusted, the angle thought to be preferable to be in the range of 0~45°.

In addition, the LED lighting modules 1 are disposed independently or in groups and the angles of said LED lighting modules 1 are independently adjusted, if necessary.

The installation angles of the LED lighting modules 1 and the multi-bending reflection minor 62 are adjusted by changing the configuration between the LED module base 51 and the LED module bracket 31 using the bolts of the LED module clamp 32.

The multi-bending reflection minor 62, which is combined with the LED lighting modules 1, reflects light emitted so as to increase the reflection efficiency.

In addition, at least more than two radiation fins, which are semi-spherical and concave, are formed on the surface of the multi-bending reflection minor 62 so that glaringness can be decreased with a little angle change in an eye level.

A cover 82 is attached to the bottom surface of the casing 70 using bolts or clips.

It is preferable that the cover 82 is transparent or semitransparent so as to allow light to transmit, and that said cover 82 is made up of plastic, tempered glass, and so forth.

The converter 71 is formed on a portion of the outside of the casing 70, a power supply for the LED lighting modules 1. In this case, the converter 71 is protected by a converter external case 72 which is quadrilateral-shaped with one of its portions open.

A converter external case 72 is composed of a heat radiation plate with radiation fins perpendicular to the surface of the case for releasing heat.

As shown in FIG. 9, a symmetric LED lighting apparatus 61*a* with a composite lens according to the present invention is the same as the embodiment depicted in FIG. 8 except the fact that the casing 70 further comprises a symmetric side wall 74 aslope and the converter 71 is separated from the casing 70.

Figure 10:
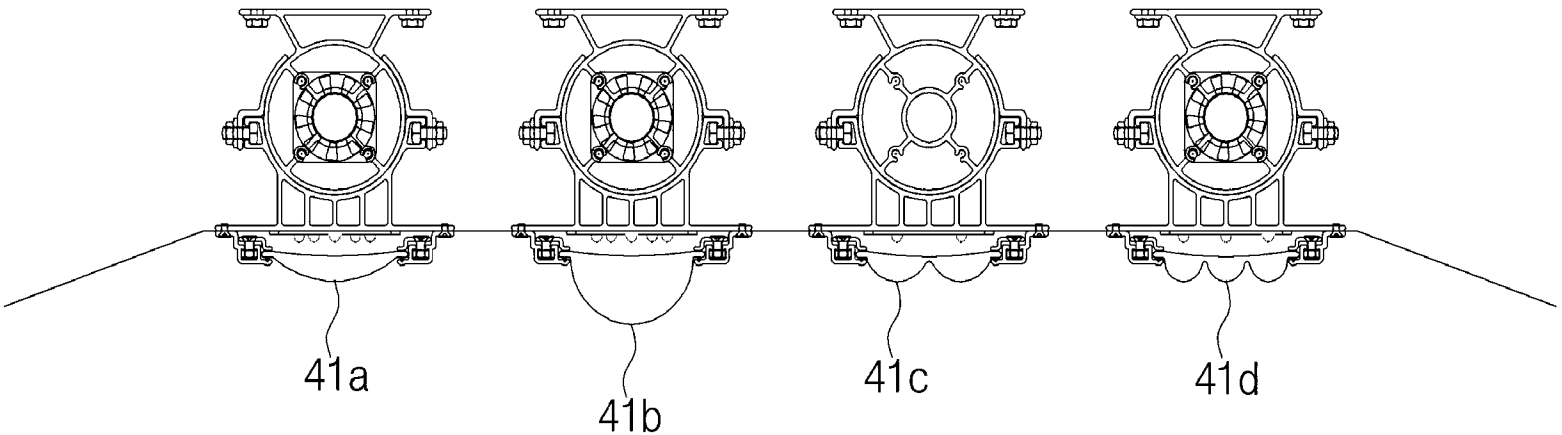
FIG. 10 is a cross-sectional view of the lenses according to the third preferred embodiment of the present invention.

FIG. 10 is a cross-sectional view of the lenses according to the present invention.

As shown in FIG. 10, the lenses 41 installed to the LED lighting module 1 according to the present invention comprises oval convex lenses 41*a*, semi-spherical convex lenses 41*b*, double oval convex lenses 41*c*, or triple oval convex lenses 41*d*.

In this case, each lens 41 is matched and connected to the LED lighting module 1 one by one, or, if necessary, the lenses 41 are divided into more than two groups and connected to the LED lighting module 1.

The curved surface of the oval convex lens 41*a* formed on the lower portion of the lens 41 has a moderate curvature.

The oval convex lens 41*a* can disperse light and irradiate the light at a wide range, wherein the strength of the light and the range of dispersion varies according to the number of the LED chips 11 installed to the metal PCB board 21.

The curved surface of the semi-spherical convex lens 41*b* formed on the lower portion of the lens 41 is in the shape of a half circle.

In this case, the semi-spherical convex lens 41*b* is formed bigger than the oval convex lens 41*a* and changes the strength of the light in accordance with the number of the LED chips 11 installed in the metal PCB board 21. The curved surface of the double oval convex lens 41*c* formed on the lower portion of the lens 41 is composed of two curved surfaces.

The curved surface of the triple oval convex lens 41*d* formed on the lower portion of the lens 41 is composed of three curved surfaces.

A suitable lens 41 is selected between a double oval convex lens 41*c* and a triple oval convex lens 41*d* in accordance with the number of the LED chips 11 installed on the LED lighting module 1.

In detail, in case a double oval convex lens 41*c* is selected, the number of the LED chips 11 installed on the LED lighting module 1 is two.

As mentioned above, the lens 41 is in various shapes; therefore, the LED lighting apparatuses 61, 61*a* can be composed of either the lenses with the same shape or the lenses selected from more than two groups with different shapes in accordance with the condition of the facilities and their purpose in use.

Figure 11:
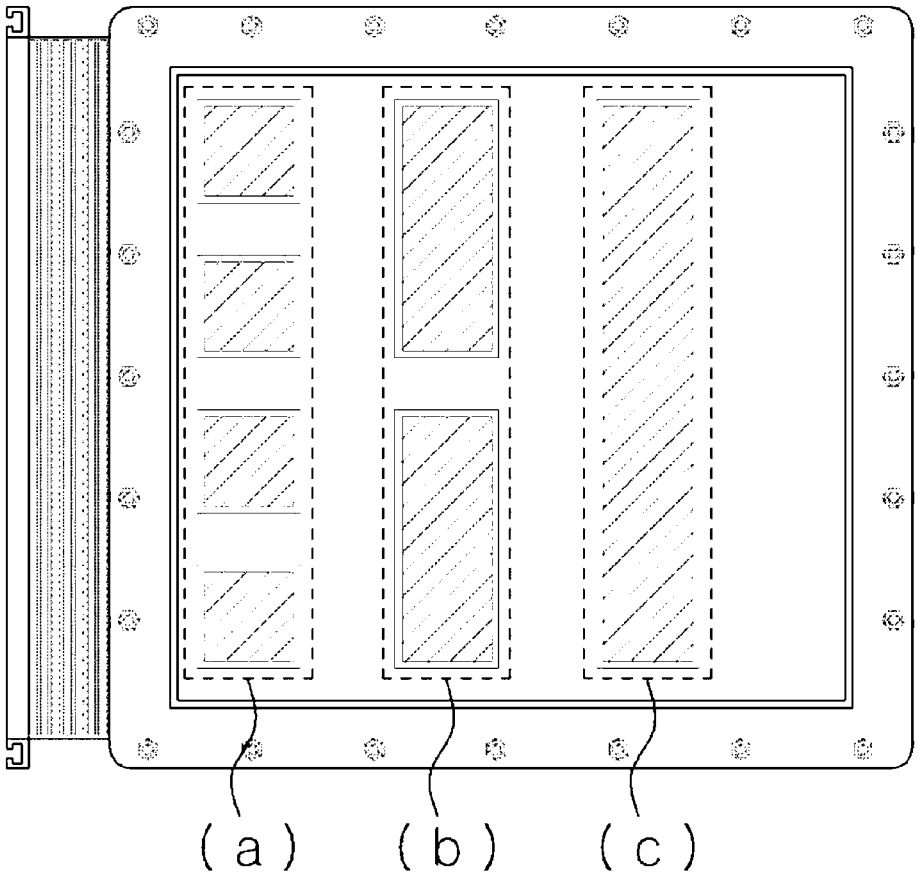
FIG. 11 is a perspective view of a LED lighting apparatus according to each preferred embodiment of the present invention, showing the arrangement structure of its bottom.

FIG. 11 is a perspective view of a LED lighting apparatus system comprising composite lenses according to the present invention, showing the arrangement structure of its bottom.

As shown in FIG. 11, the LED lighting apparatus system according to the present invention comprises three columns: (a), (b), and (c).

In this case, the arrangement of the LED lighting modules 1 installed in the LED lighting apparatuses 61, 61*a* forms 1 to 3 columns; however, if necessary, the number of columns can be increased over three.

In detail, the arrangement structure of the LED lighting apparatus is as follows.

Firstly, FIG. 11(*a*) shows an arrangement that each lens 41 is independently installed to the LED lighting module 1 one by one, whereas FIG. 11(*b*) shows an arrangement that the LED lighting modules 1 are divided into two groups, a semi-spherical convex lens 41*b* is allocated to one group, and an oval convex lens selected from three types of oval convex lens 41*a*, 41*c*, 41*d* is allocated to the other group. On the other hand, FIG. 11(*c*) shows an arrangement that the type of lens is selected first among semi-spherical convex lens, oval convex lens, double oval convex lens, and triple oval convex lens and then the lens is allocated to all of the LED lighting modules 1 in line.

As shown before, it is possible that the embodiment concerning the arrangement of columns in LED lighting apparatuses 61, 61*a* could be accomplished either in an independent manner or in a mixed manner with two types of lenses or more.

In case the lenses 41 with the same type are allocated to a whole column, the number of the LED chips 11 installed on the LED lighting module 1 is preferable to be the same.

The LED lighting apparatuses 61, 61*a* with the composite lens described above is advantageous in that, if necessary, it can concentrate rays of light into a specific spot and, also, it can uniformly disperse the light into the wide open space, and in that it can change its angle in accordance with the facility and its purpose.

As described above, although the preferred embodiments of the present invention have been described in the description, those skilled in the art will appreciate that various modifications are possible to be devised without departing from the scope and spirit of the present invention. Therefore, the scope of protection of the present invention should be decided based on the claims and their equivalents, as well as the embodiments disclosed in the description.

INDUSTRIAL APPLICABILITY

The present invention can be applied to a LED lighting apparatus. More specifically, the present invention is industrially applicable in that it provides a LED lighting apparatus which maximizes the radiation of heat from LED chips, freely adjusts the angle of the LED lighting module, and adopts various types of lens.

What is claimed is:

1. An asymmetric LED lighting apparatus, comprising:

a quadrilateral-shaped asymmetric casing with a side wall inclined;

a LED lighting module array disposed inside the casing and composed of a plurality of LED lighting modules lined up to emit light;

a converter formed on a portion of the outside of the casing supplying power to the LED lighting modules; and a multi-bending reflection mirror reflecting light emitted from the LED lighting modules, wherein the LED lighting module array comprises a LED module base combined with a portion of the upper inside surface of the casing; a plurality of LED module brackets connected to a lower portion of the LED module base; a plurality of metal PCB boards combined with a lower portion of each LED module bracket; a plurality of LED chips mounted on the metal PCB boards; and a plurality of lenses concentrating rays of light emitting from the LED chips into focus.

2. A symmetric LED lighting apparatus, comprising:

a quadrilateral-shaped symmetric casing with both side walls inclined;

a LED lighting module array disposed inside the casing and composed of a plurality of LED lighting modules lined up to emit light;

a converter separately formed from the casing supplying power to the LED lighting modules; and a multi-bending reflection mirror reflecting light emitted from the LED lighting modules, wherein the LED lighting module array comprises a LED module base combined with a portion of the upper inside surface of the casing; a plurality of LED module brackets connected to a lower portion of the LED module base; a plurality of metal PCB boards combined with a lower portion of each LED module bracket; a plurality of LED chips mounted on the metal PCB boards; and a plurality of lenses concentrating rays of light emitting from the LED chips into focus.

3. The LED lighting apparatus of claim 1, wherein each lens is combined with a lens base, and the lens and the lens base are combined with a lens base cover.

4. The LED lighting apparatus of claim 1, wherein the casing comprises a heat radiation plate to release heat.

5. The LED lighting apparatus of claim 1, wherein the casing further comprises a cover allowing light to transmit in the lower surface.

6. The LED lighting apparatus of claim 1, wherein the LED module brackets comprise an arch-shaped concave upper portion and a quadrilateral-shaped flat lower portion, the upper portion and the lower portion connected with each other using a plurality of supporting rods.

7. The LED lighting apparatus of claim 1, wherein the LED module bracket and the LED module base are joined together using LED module clamps.

8. The LED lighting apparatus of claim 7, wherein the angle of the LED lighting module is adjusted by changing the configuration of the LED module bracket using bolts of the LED module clamp.

9. The LED lighting apparatus of claim 8, wherein the angle is in the range of 0~45°.

10. The LED lighting apparatus of claim 1, wherein the lenses are in the shape of convex.

11. The LED lighting apparatus of claim 1, wherein the LED lighting modules are disposed independently or in groups to form the LED lighting module array, and wherein the angles of the LED lighting modules are independently adjusted to either the same or different angle.

12. A LED lighting apparatus with a mixed lens, comprising:

a quadrilateral-shaped casing serving as housing and having a lower portion open;

a LED lighting module array disposed inside the casing and composed of a plurality of LED lighting modules lined up to emit light;

a converter formed on a portion of the outside of the casing supplying power to the LED lighting modules; and a multi-bending reflection mirror reflecting light emitted from the LED lighting modules, wherein the LED lighting module array comprises a LED module base combined with a portion of the upper inside surface of the casing; a plurality of LED module brackets connected to a lower portion of the LED module base; a plurality of metal PCB boards combined with a lower portion of each LED module bracket; a plurality of LED chips mounted on the metal PCB boards; and a plurality of lenses concentrating rays of light emitting from the LED chips into focus, the lenses having curved surfaces or various curvatures.

13. The LED lighting apparatus of claim 12, wherein the casing is either asymmetric with a side wall inclined or symmetric with both side walls inclined.

14. The LED lighting apparatus of claim 12, wherein the LED lighting modules are disposed independently or in groups to form the LED lighting module array, and wherein the angles of the LED lighting modules are independently adjusted to either the same or different angle.

15. The LED lighting apparatus of claim 12, wherein the lens is a convex type.

16. The LED lighting apparatus of claim 15, wherein the lens is formed in one of the shapes of a circle, a quadrilateral or a polygon, and wherein the curved surface is formed in the shape of semi-spherical convex lens or oval convex lens.

17. The LED lighting apparatus of claim 12, wherein the lens is long and bar-shaped.

18. The LED lighting apparatus of claim 12, wherein an O-ring is inserted between the lens and the lens base cover.

19. The LED lighting apparatus described in claim 1, wherein a cooling fan is attached to a side portion of the LED module base.

* * * * *